US011520265B2

(12) United States Patent
Honda

(10) Patent No.: US 11,520,265 B2
(45) Date of Patent: Dec. 6, 2022

(54) IMAGE FORMING APPARATUS

(71) Applicant: KYOCERA Document Solutions Inc., Osaka (JP)

(72) Inventor: Takahiro Honda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/531,978

(22) Filed: Nov. 22, 2021

(65) Prior Publication Data

US 2022/0163913 A1 May 26, 2022

(30) Foreign Application Priority Data

Nov. 26, 2020 (JP) ..... JP2020-196007

(51) Int. Cl.
*G03G 15/00* (2006.01)
*G03G 15/08* (2006.01)

(52) U.S. Cl.
CPC ..... *G03G 15/5041* (2013.01); *G03G 15/0844* (2013.01); *G03G 15/5058* (2013.01); *G03G 15/556* (2013.01)

(58) Field of Classification Search
CPC ..... G03G 15/5041; G03G 15/556; G03G 15/5058; G03G 15/0844
See application file for complete search history.

(56) References Cited

U.S. PATENT DOCUMENTS

2018/0143575 A1* 5/2018 Katahira ..... G03G 15/556
2019/0018342 A1* 1/2019 Sakamoto ..... G03G 15/5058
2019/0094800 A1* 3/2019 Itaya ..... G03G 15/556

FOREIGN PATENT DOCUMENTS

JP 2016-114835 6/2016

* cited by examiner

*Primary Examiner* — Sandra Brase
(74) *Attorney, Agent, or Firm* — Lex IP Meister, PLLC

(57) ABSTRACT

In an image forming apparatus, a calibration controller controls an exposure device to form a toner patch image for calibration in a non-printable area outside a printable area in a main scanning direction, and executes at least one of density adjustment and gradation adjustment based on a density measurement value of the toner patch image. A toner refresh controller controls the exposure device to form a toner band for toner refresh in accordance with a coverage rate. Further, when the length of the toner band to be formed in the non-printable area exceeds a predetermined threshold value, the toner refresh controller forms at least a part of the toner band to be formed in the non-printable area in parallel with a subsequent page image.

5 Claims, 6 Drawing Sheets

IMAGE FORMING APPARATUS

INCORPORATION BY REFERENCE

This application is based upon and claims the benefit of priority from the corresponding Japanese Patent Application No. 2020-196007 filed on Nov. 26, 2020, the entire contents of which are incorporated herein by reference.

BACKGROUND

The present disclosure relates to image forming apparatus.

In the image forming apparatus of electrophotographic method, when the coverage rate at the time of printing is low, the toner consumption amount decreases, and the quality of toner in the developing roller decreases over time, and the quality of the print image also decreases. Therefore, a toner refresh operation is performed. In the toner refresh operation, a toner band is discharged from the developing device between page images (toner images) in a print image. This toner band is recovered without transfer to print paper.

SUMMARY

An image forming apparatus according to this disclosure includes a photosensitive drum, an exposure device, a developing device, a calibration controller, and a toner refresh control part.

The exposure device exposes the photosensitive drum to form an electrostatic latent image on the photosensitive drum.

The developing device causes toner to adhere to the electrostatic latent image on the photosensitive drum.

The calibration controller controls the exposure device to form a toner patch image for calibration in a non-printable area outside a printable area in a main scanning direction, and executes at least one of density adjustment and gradation adjustment based on a density measurement value of the toner patch image.

The toner refresh controller controls the exposure device to form a toner band for toner refresh in accordance with a coverage rate.

Further, when the length of the toner band to be formed in the non-printable area exceeds a predetermined threshold value, the toner refresh controller forms at least a part of the toner band to be formed in the non-printable area in parallel with a subsequent page image.

DETAILED DESCRIPTION

Hereinafter, embodiments of the present disclosure will be described based on figures.

Some image forming apparatuses perform calibration for density adjustment and gradation adjustment. In the calibration, a patch image having a specific toner density is formed. The density of the patch image is optically measured, and density adjustment and gradation adjustment are automatically executed based on the measured density value. In this case, when a patch image is formed in a non-printable area outside a printable are where a print image can be formed in a main scanning direction (a direction perpendicular to a conveyance direction of a toner image), a toner refresh operation is required also for the non-printable area in order to maintain the quality of the patch image.

In the non-printable area, since a page image to be printed is not formed and a coverage rate (that is, a toner consumption amount per predetermined unit time or predetermined unit length) is low, a large amount of toner is discharged in the toner refresh operation. Therefore, the toner band in the non-printable area becomes longer in the image conveyance direction.

Figure 6:
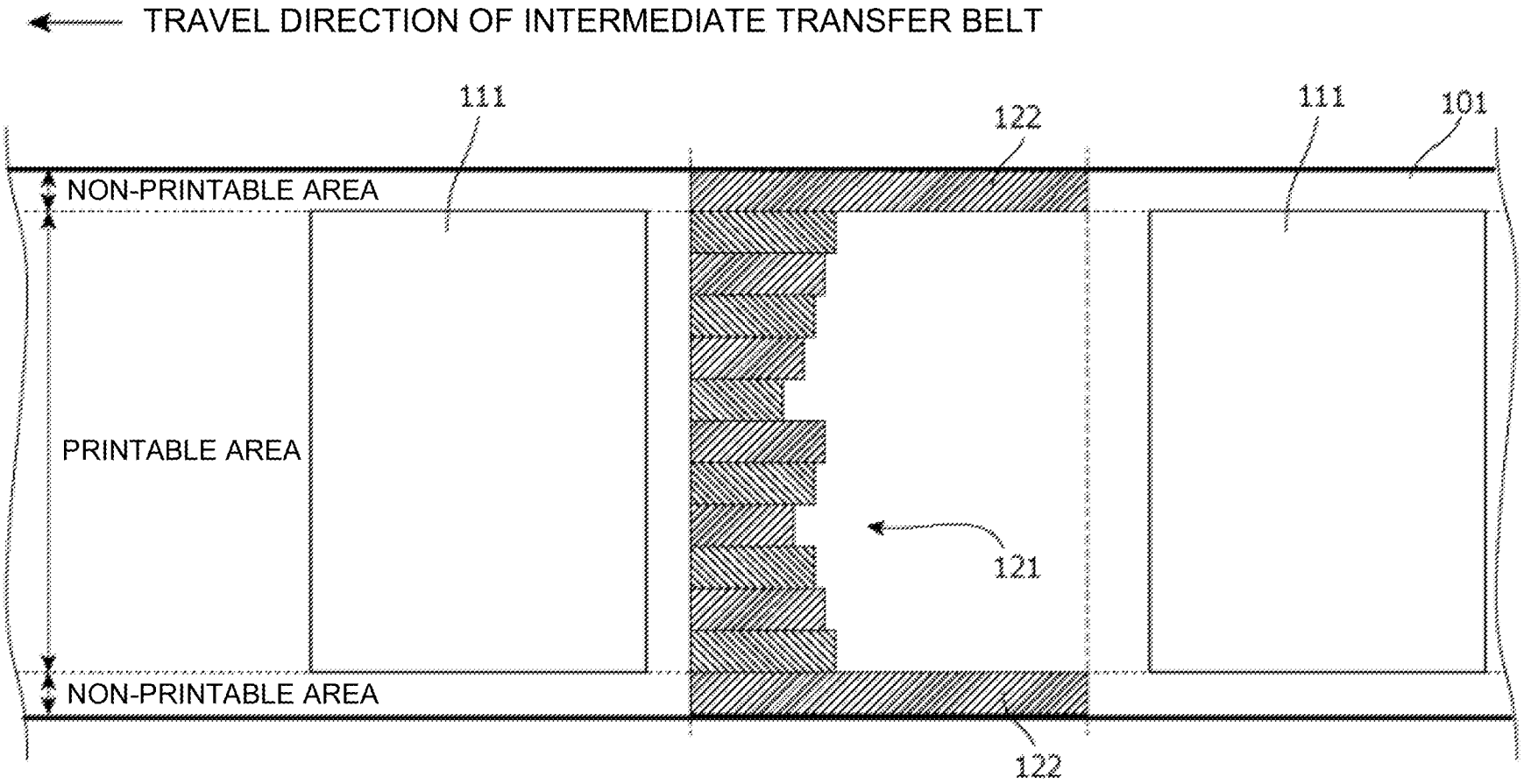
FIG. 6 is figure describing the toner band to be formed in the toner refresh operation.

FIG. 6 is a figure describing the toner band to be formed in the toner refresh operation. For example, as shown in FIG. 6, toner bands 121 and 122 are formed between the page images 111 on the intermediate transfer belt 101. In each of a plurality of divided areas obtained by dividing the printable area in the main scanning direction, the toner band 121 is formed to have a length corresponding to the coverage rate of the divided area. Further, the toner band 122 is formed in the non-printable area so as to have a length corresponding to the coverage rate of the non-printable area. As described above, since the coverage rate of the non-printable area is low, the toner band 122 is formed to be relatively long, for example, as shown in the FIG. 6.

As described above, in a case where the toner band 122 is formed to be relatively long, an interval between the page images 111 before and after the toner bands 121 and 122 becomes long, and productivity (the number of printed sheets per unit time) is reduced.

The present disclosure has been made in consideration of the above problem, and an object thereof is to obtain an image forming apparatus that suppresses a decrease in productivity caused by a toner refresh operation.

First Embodiment

Figure 1:
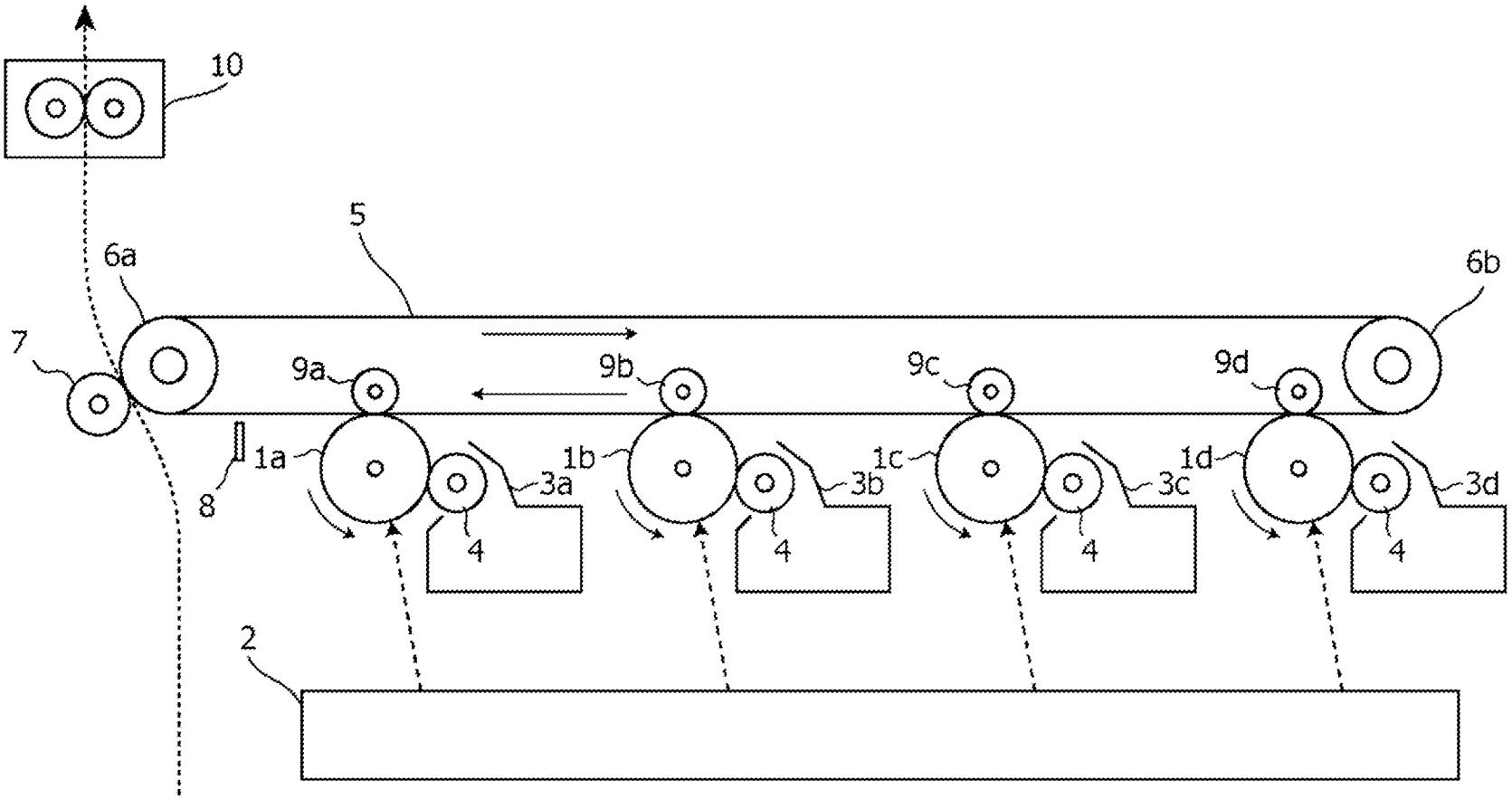
FIG. 1 is a side view figure showing the mechanical internal structure of the image forming apparatus according to an embodiment of the present disclosure.

FIG. 1 is a side view figure showing the mechanical internal structure of the image forming apparatus according to an embodiment of the present disclosure. The image forming apparatus shown in FIG. 1 is an apparatus having a printing function of an electrophotographic method, such as a printer, a facsimile machine, a copying machine, or a multifunction peripheral.

The image forming apparatus of this embodiment has a tandem color developing device. The color developing apparatus includes photosensitive drums 1*a* to 1*d*, an exposure device 2 and developing devices 3*a* to 3*d*. The photosensitive drums 1*a* to 1*d* is a photoreceptor of four colors of cyan, magenta, yellow and black, and an electrostatic latent image is formed on the photosensitive drums 1*a* to 1*d*. The exposure device 2 is a device that exposes the photosensitive drums 1*a* to 1*d* (here with laser light) to form an electrostatic latent image on the photosensitive drums 1*a* to 1*d*. The exposure device 2 includes a laser diode that is a light source of laser light and an optical element (a lens, a mirror, a polygon mirror, or the like) that guides the laser light to the photosensitive drums 1*a* to 1*d*. The photosensitive drums 1*a* to 1*d* may be made of amorphous silicon or may be an organic photoreceptor (OPC).

The developing devices 3*a* to 3*d* form a toner image by attaching the toner in the toner cartridge to the electrostatic latent image on the photosensitive drums 1*a* to 1*d* with a developing roller 4. Black development is performed by the photosensitive drum 1*a* and the developing device 3*a*, yellow development is performed by the photosensitive drum 1*b* and the developing device 3*b*, cyan development is performed by the photosensitive drum 1*c* and the developing device 3*c*, and magenta development is performed by the photosensitive drum 1*d* and the developing device 3*d*.

The intermediate transfer belt 5 is an annular image carrier, which contacts the photosensitive drums 1*a* to 1*d*, to which the toner image on the photosensitive drums 1*a* to 1*d* is transferred, and which carries the toner image. The intermediate transfer belt 5 is stretched around the driving roller 6*a* and the tension roller 6*b*, and is rotationally moved in a direction from a contact position with the photosensitive drum 1*a* to a contact position with photosensitive drum 1*d* by a driving force from the driving roller 6*a*.

The secondary transfer roller 7 brings the conveyed print sheet (print paper or the like) into contact with the intermediate transfer belt 5, and secondary transfers the toner image on the intermediate transfer belt 5, onto the print sheet. The print sheet with the secondary transfer of the toner image is conveyed to the fixing device 10. The fixing device 10 includes a heater and uses the heater to fix a toner image on a print sheet in a heating and pressurizing manner.

The density sensor 8 is a reflective optical sensor that emits light to the intermediate transfer belt 5, receives reflection light (for example, specular reflection light and diffuse reflection light) therefrom, and outputs electric signals corresponding to the amount of the received reflection light. The density sensor 8 optically detects the density of the toner image on the intermediate transfer belt 5 after the calibration toner patch image is primarily transferred to the intermediate transfer belt 5. Here, the density sensor 8 is disposed in a non-printable area outside a printable area (an area in which a page image to be printed can be formed) in the main scanning direction, and measures the density of a calibration toner patch image passing through the disposed position. To be specific, the density sensor 8 emits light to the measurement area, receives the reflection light, and measures the density of the toner patch image passing through the measurement area.

Each of the primary transfer rollers 9*a* to 9*d* is disposed so as to face the photosensitive drums 1*a* to 1*d* with the intermediate transfer belt 5 interposed therebetween, and a toner image on the photosensitive drums 1*a* to 1*d* is primary transferred from the photosensitive drums 1*a* to 1*d* to the intermediate transfer belt 5.

Figure 2:
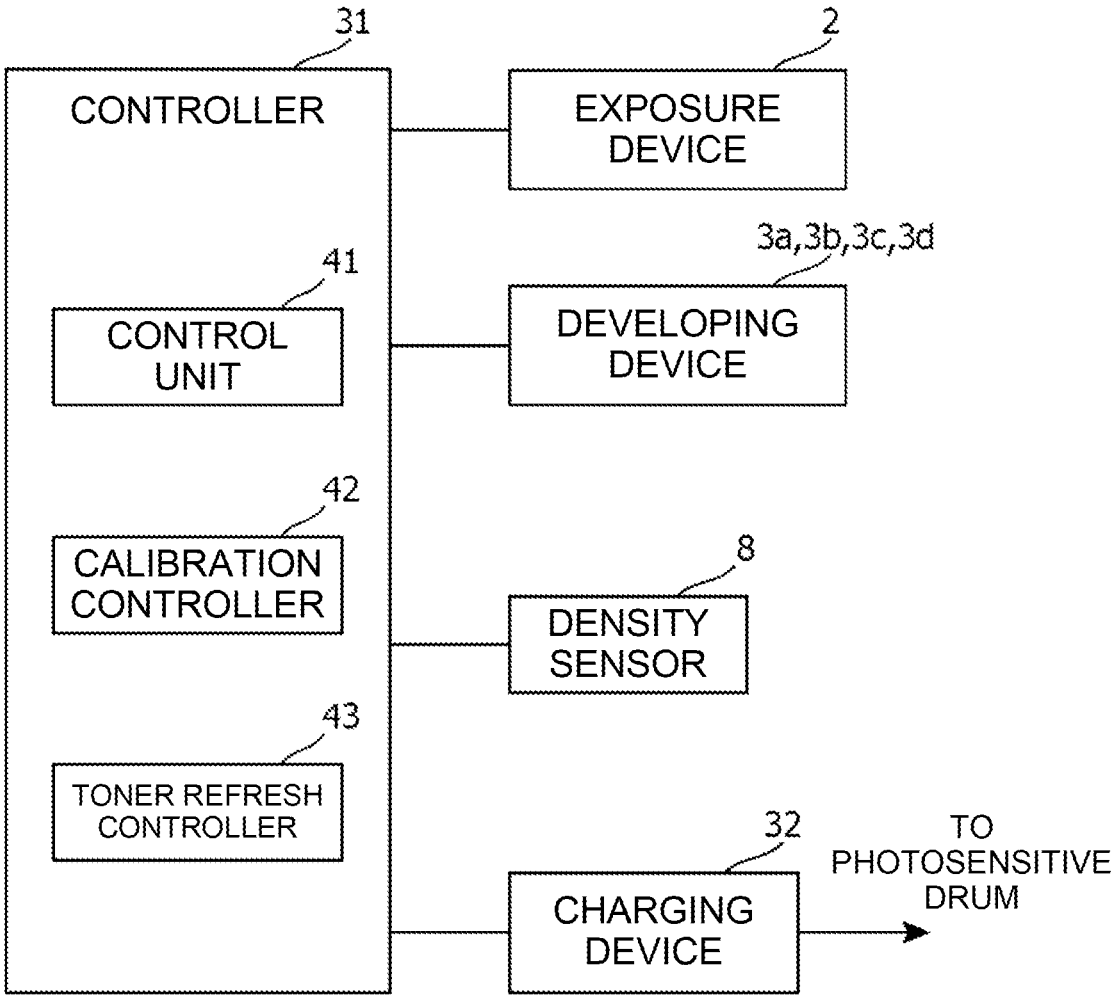
FIG. 2 is a block diagram showing part of the electrical configuration of image forming apparatus shown in FIG. 1.

FIG. 2 is a block diagram showing a part of an electrical configuration of an image forming apparatus shown in FIG. 1. As shown in FIG. 2, the image forming apparatus shown in FIG. 1 further comprises a controller 31 and a charging device 32.

The controller 31 electrically controls each unit in the image forming apparatus. The controller 31 include a microcomputer, an application specific integrated circuit (ASIC), and the like, and operates as various processing units that perform one or both of hardware processing and software processing. The charging device 32 charges the surface potential of the photosensitive drums 1*a* to 1*d* to a predetermined potential (dark potential) or sets the surface potential of the photosensitive drums 1*a* to 1*d* to 0 volt (ground level).

The controller 31 operates as a control unit 41, calibration controller 42, and toner refresh controller 43.

The control unit 41 controls the mechanical configuration (the photosensitive drums 1*a* to 1*d*, the exposure device 2, the developing devices 3*a* to 3*d*, etc.) shown in the FIG. 1 to execute printing, calibration, toner refresh, etc.

Figure 3:
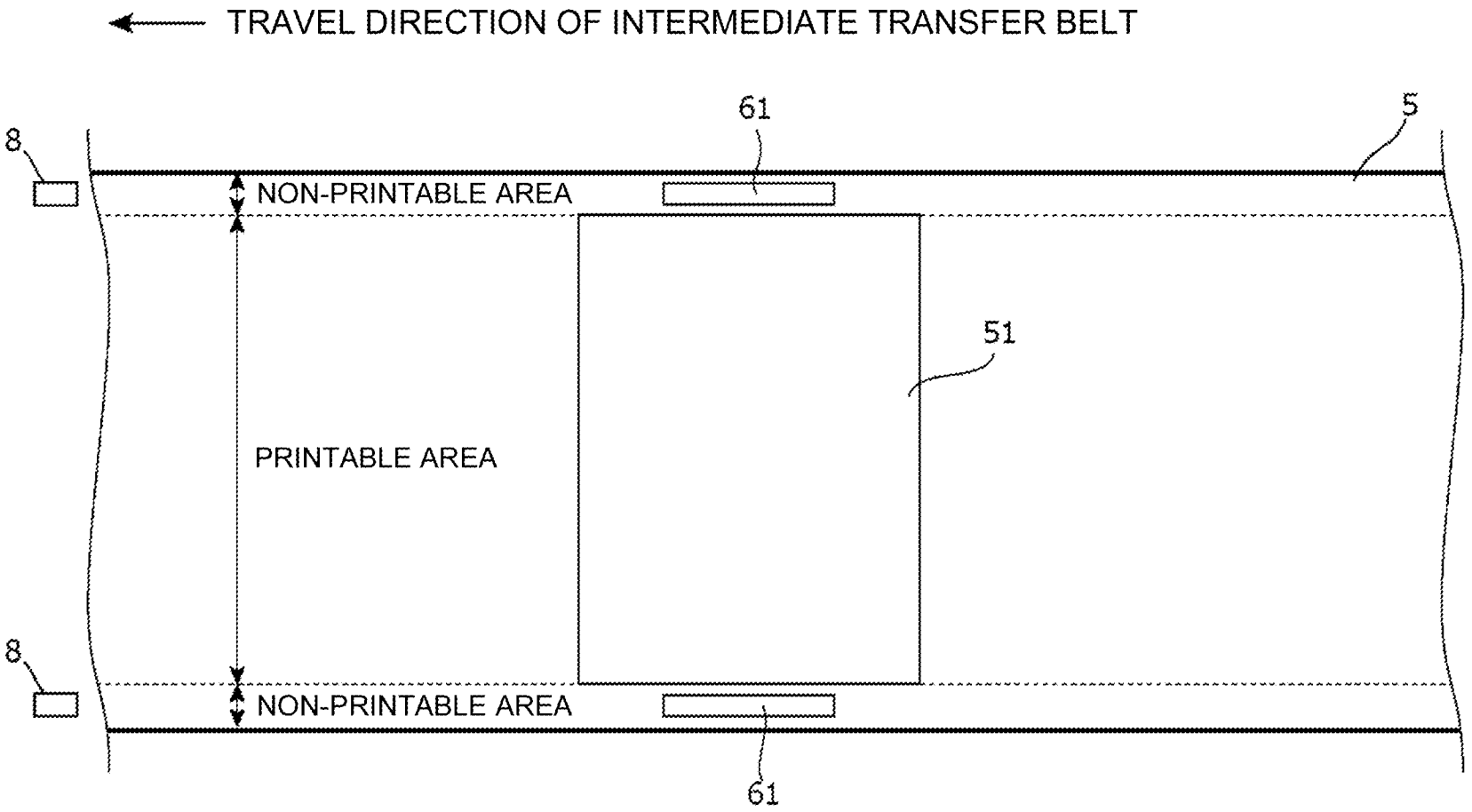
FIG. 3 is a figure for explaining a printable area and a non-printable area in the main scanning direction.

FIG. 3 is a figure for explaining a printable area and a non-printable area in the main scanning direction.

The calibration controller 42 executes calibration periodically or repeatedly at a predetermined timing. In calibration, the calibration controller 42 controls the exposure device 2 via the control unit 41 to form a toner patch image 61 for calibration in a non-printable area outside the printable area (that is, an area in which a page image 51 to be printed can be formed) in the main scanning direction, as shown in FIG. 3, and executes at least one (here, both) of density adjustment and gradation adjustment based on the measured density value of the toner patch image 61 obtained by the density sensor 8.

Specifically, the calibration controller 42 controls the exposure device 2 to expose the photosensitive drums 1*a* to 1*d* to the exposure device 2 such that an electrostatic latent image corresponding to the toner patch image 61 is formed in the non-printable area. Then, the developing devices 3*a* to 3*d* cause toner to adhere to the electrostatic latent image formed in this manner, whereby the toner patch image 61 is formed and is primary transferred on the intermediate transfer belt 5.

Toner refresh controller 43 controls the exposure device 2 through the control unit 41 to form a toner band for toner refresh according to a coverage rate. The printable area is divided into a plurality of divided areas, and the coverage rate of each of the divided areas (coverage rate for each divided area in a predetermined number of page images immediately before the toner band) is measured, and the length of the toner band (toner image of a predetermined constant density) in each divided area is derived so that the coverage rate in the entire divided areas and the non-printable area becomes a predetermined lower limit value or more, and the coverage rate in the entire divided areas and the non-printable area approaches a uniform state according to the coverage rate in the divided area.

Specifically, the toner refresh controller 43 controls the exposure device 2 to force the exposure device 2 to expose the photosensitive drums 1*a* to 1*d* so that electrostatic latent image corresponding to toner bands is formed in the printable and non-printable areas. Then, the developing devices 3*a* to 3*d* causes toner to adhere to the electrostatic latent image thus formed, whereby a toner band is formed and is primary transferred to the intermediate transfer belt 5.

Figure 4:
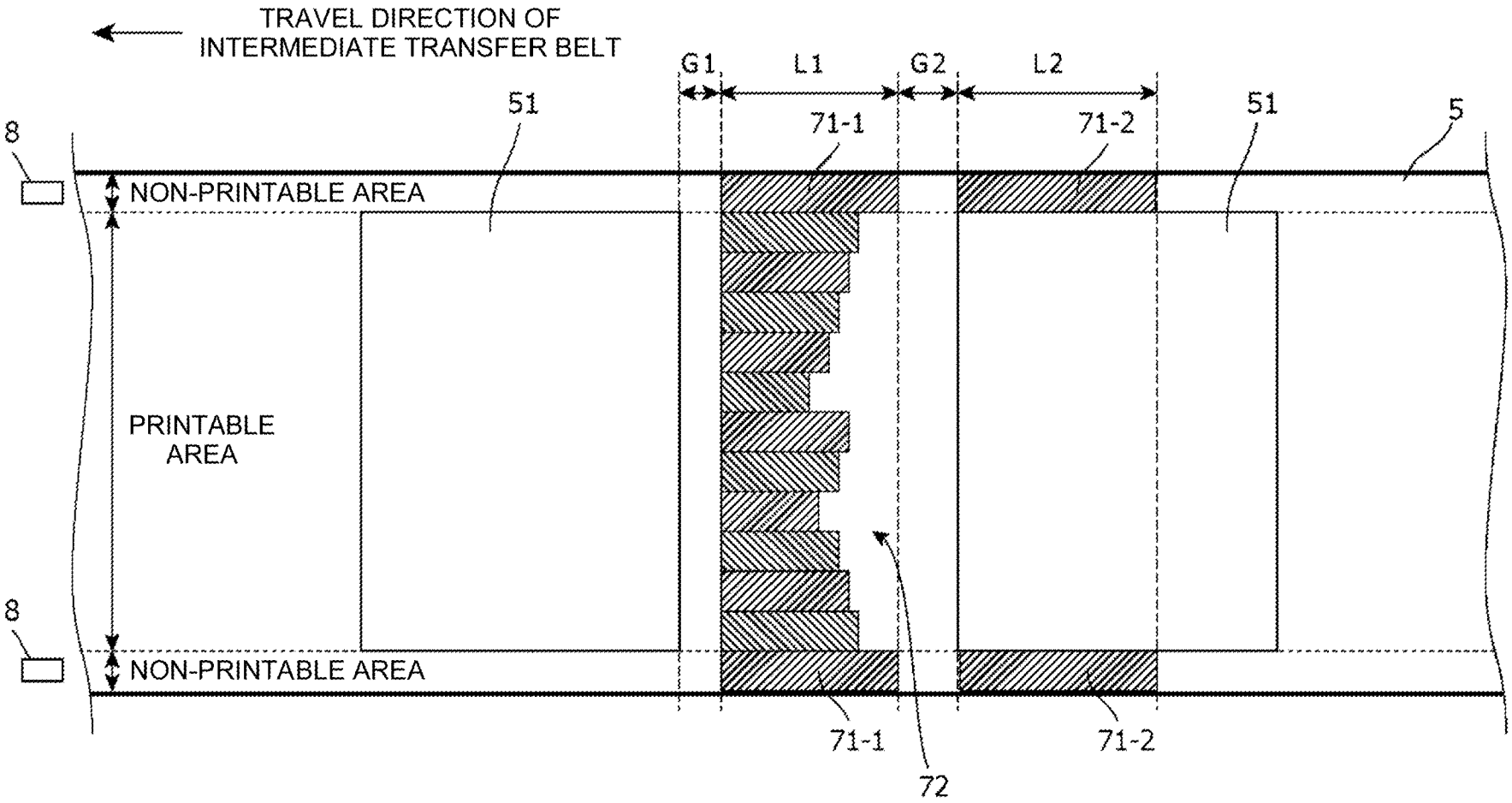
FIG. 4 is a figure describing toner bands formed during toner refresh operations in image forming apparatus shown in FIG. 1 and FIG. 2.

FIG. 4 is a figure describing toner bands formed during toner refresh operations in image forming apparatus shown in FIG. 1 and FIG. 2.

For example, as shown in FIG. 4, when the length of the toner band to be formed in the non-printable area exceeds a predetermined threshold value, the toner refresh controller 43 forms at least a part of the toner band to be formed in the non-printable area in parallel with the subsequent page image 51.

Here, an interval of a predetermined length G1 is set between the page image 51 preceding the toner band and the toner band, and the page image 51 subsequent the toner band is formed by leaving an aging section equal to or longer than the lower limit length G2 from the rear end of the toner band. When the length of the toner band to be formed in the non-printable area exceeds a predetermined threshold value, the toner refresh controller 43 divides the toner band to be formed in the non-printable area into two divided toner bands 71-1 and 71-2, forms one of the divided toner bands (divided toner band 71-1) in parallel with the toner band 72 to be formed in the printable area, and forms the other of the divided toner bands (divided toner band 71-2) in parallel with the subsequent page image 51 with at least an aging section from the rear end of one of the divided toner bands (divided toner band 71-1).

Here, the predetermined threshold value is set to a value (Gp-G1-G2) obtained by subtracting the interval length G1 and the lower limit length G2 of the aging section from the length Gp of the interval between the page images 51.

Figure 5:
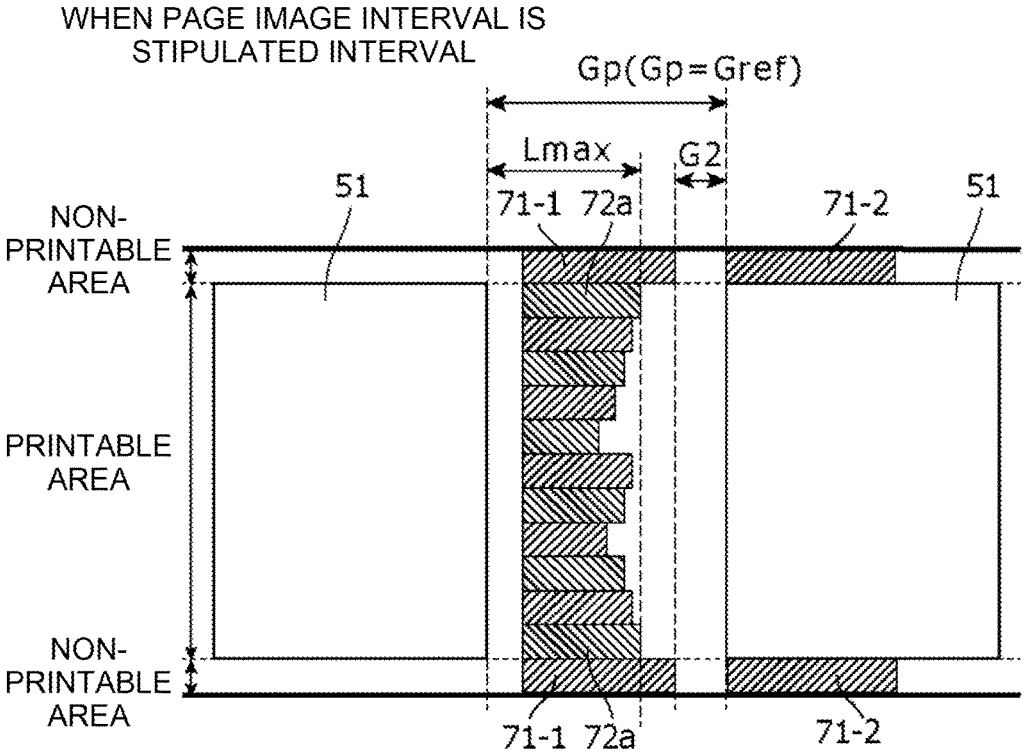
FIG. 5 is a figure explaining an interval between page images before and after a toner band formed in a toner refresh operation in image forming apparatus shown in FIG. 1 and FIG. 2.
Figure 5:
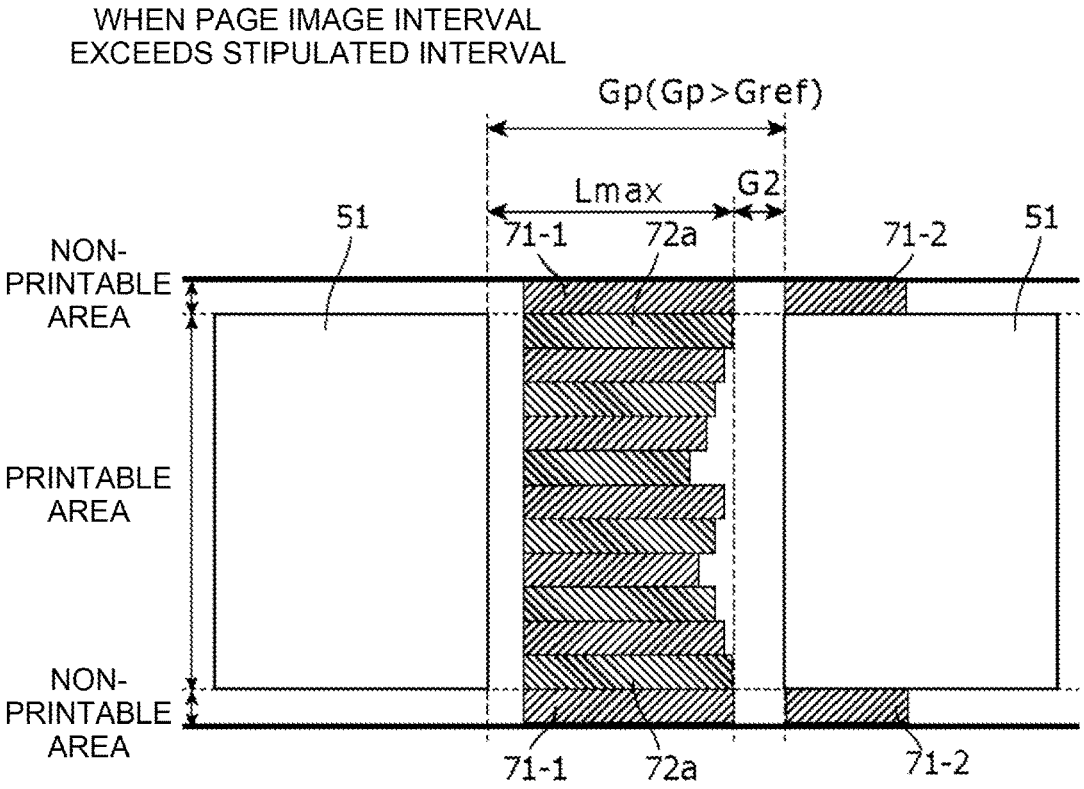

FIG. 5 is a figure describing an interval between page images 51 before and after the toner band formed in the toner refresh operation in image forming apparatus shown in FIG. 1 and FIG. 2.

Here, the length Gp of the interval between the page images 51 before and after the toner band is adjusted according to the length of the toner band 72. To be specific, the length L1 of one divided toner band (divided toner band 71-1) is obtained by subtracting the length G1 of the interval between the one divided toner band and the preceding page image 51 and the lower limit length G2 (fixed value, for example, 50 mm) of the aging section from the length Gp of the page image interval.

For example, as shown in FIG. 5, the length Gp of the page image interval is the longer of (a) a predetermined specified length Gref of the page image interval, and (b) the sum of the distance Lmax from the rear end of the preceding page image 51 to the rear end of the toner band 72 to be formed in the printable area (that is, the rear end of the longest toner band 72*a* among the toner bands 72 in the plurality of divided areas) and the lower limit length G2 of the aging section. That is, if the sum of the distance Lmax and the lower limit length G2 of the aging section is equal to or less than the specified length Gref, the length Gp of the page image interval is equal to the specified length Gref, otherwise, the length Gp of the page image interval is equal to the sum of the distance Lmax and the lower limit length G2 of the aging section. Note that the length Gp of the page image interval in which the toner band 72 is not formed is a specified length Gref.

Next, the operation of the image forming apparatus will be described.

The toner refresh controller 43 stores a coverage rate in a storage device (memory, etc.) as coverage rate data for each print and calibration, and when a predetermined toner refresh timing arrives, derives the coverage rate of each divided area of the printable area and non-printable area on the basis of the coverage rate data, and specifies the length of a toner band to be formed in each divided area of the printable area and non-printable area on the basis of the coverage rate.

Then, as described above, the toner refresh controller 43 sets the toner bands to be formed in the non-printable area to be divided toner bands 71-1, 71-2 as necessary, forms the toner bands 72 in the printable area and the divided toner bands 71-1 between the page images 51 in the sub-scanning direction (image conveyance direction), and forms the divided toner bands 71-2 in parallel with the subsequent page images 51.

As described above, according to the above-described embodiment, the calibration controller 42 controls the exposure device 2 to form the toner patch image 61 for calibration in the non-printable area in the main scanning direction, and executes at least one of density adjustment and gradation adjustment based on the density measurement value of the toner patch image 61. The toner refresh controller 43 controls the exposure device 2 to form a toner band for toner refresh according to the coverage rate. When the length of the toner band to be formed in the non-printable area exceeds a predetermined threshold value, the toner refresh controller 43 forms at least a part of the toner band to be formed in the non-printable area in parallel with the subsequent page image 51.

As a result, even if the toner band to be formed in the non-printable area is relatively long, the page image interval does not become long, so that a decrease in productivity caused by the toner refresh operation is suppressed.

Second Embodiment

In the image forming apparatus according to the second embodiment, when the toner refresh controller 43 determines that the toner band 72 to be formed in the printable area (the toner band 72 of all the divided areas described above) is unnecessary based on the coverage rate, the toner refresh controller 43 forms all the toner bands to be formed in the non-printable area in parallel with the subsequent page image 51 regardless of the lengths of the toner bands to be formed in the non-printable area. To be specific, when the coverage rate of all the divided areas of the printable area is equal to or greater than the above-described lower limit value, it is determined that the toner band 72 to be formed in the printable area is unnecessary.

Other configurations and operations of the image forming apparatus according to the second embodiment are the same as those of the first embodiment, and thus description thereof will be omitted.

Third Embodiment

In the image forming apparatus according to third embodiment, when it is determined that the formation position of the toner band to be formed in the non-printable area (here, divided toner bands 71-1, 71-2) overlaps the formation position of the toner patch image 61 for calibration, the calibration controller 42 and/or the toner refresh controller 43 select the formation order of the toner band to be formed in the non-printable area (here, divided toner bands 71-1, 71-2) and the toner patch image 61 based on a predetermined setting (user setting, etc.), and the calibration controller 42 and the toner refresh controller 43 form the toner band to be formed in the non-printable area (here, divided toner bands 71-1, 71-2) and the toner patch image 61 respectively at a timing according to the selected formation order. When productivity is prioritized, formation of a toner band to be formed in a non-printable area is prioritized, and when image quality is prioritized, formation of a toner patch image 61 is prioritized.

Since other configurations and operations of the image forming apparatus according to the third embodiment are the same as those of the first embodiment, description thereof will be omitted.

Various modifications and modifications to the above-described embodiments will be apparent to those skilled in the art. Such changes and modifications may be made without departing from the spirit and scope of the subject matter and without diminishing the intended advantage. That is, such changes and modifications are intended to be included in the claims.

The invention claimed is:

1. An image forming apparatus comprising:

a photosensitive drum;

an exposure device that exposes the photosensitive drum to form an electrostatic latent image on the photosensitive drum;

a developing device that causes toner to adhere to the electrostatic latent image on the photosensitive drum;

a calibration controller that controls the exposure device to form a toner patch image for calibration in a non-printable area outside a printable area in a main scanning direction, and executes at least one of density adjustment and gradation adjustment based on a density measurement value of the toner patch image; and a toner refresh controller that controls the exposure device to form a toner band for toner refresh in accordance with a coverage rate, wherein when a length of the toner band to be formed in the non-printable area exceeds a predetermined threshold value, the toner refresh controller forms at least a part of the toner band to be formed in the non-printable area in parallel with a subsequent page image.

2. The image forming apparatus according to claim 1, wherein the subsequent page image is formed by leaving an aging section having a predetermined lower limit length or longer from a rear end of the toner band, and when the length of the toner band to be formed in the non-printable area exceeds the predetermined threshold value, the toner refresh controller divides the toner band to be formed in the non-printable area into two divided toner bands, forms one of the divided toner bands in parallel with the toner band to be formed in the printable area, and forms the other of the divided toner bands in parallel with the subsequent page image by leaving at least the aging section from a rear end of the one of the divided toner bands.

3. The image forming apparatus according to claim 2, wherein a length of the one of the divided toner bands is obtained by subtracting, from a length of an interval of a page image, a length of an interval between the one of the divided toner band and a preceding page image and the lower limit length of the aging section, and the length of the interval of the page image is set to be the longer of a predetermined specified length of the interval of the page image and the sum of the distance from a rear end of the preceding page image to a rear end of the toner band to be formed in the printable area and the lower limit length of the aging section.

4. The image forming apparatus according to claim 1, wherein the toner refresh controller forms all of the toner bands to be formed in the non-printable area in parallel with the subsequent page image regardless of the length of the toner bands to be formed in the non-printable area when formation of the toner band in the printable area is determined to be unnecessary based on the coverage rate.

5. The image forming apparatus according to claim 1, wherein when it is determined that a formation position of the toner band to be formed in the non-printable area overlaps a formation position of the toner patch image for the calibration, a formation order of the toner band to be formed in the non-printable area and the toner patch image is selected based on a predetermined setting.

* * * * *